US005148948A

United States Patent [19]

Granville et al.

[11] Patent Number: 5,148,948

[45] Date of Patent: Sep. 22, 1992

[54] LIQUID SOAP DISPENSER WITH MOUNTING BASE

[75] Inventors: Richard C. Granville, Royal Oak; James C. Mourlas, St. Michaels; Michael K. Patrick, Greensboro, all of Md.

[73] Assignee: Celeste Industries Corporation, Easton, Md.

[21] Appl. No.: 726,290

[22] Filed: Jul. 5, 1991

[51] Int. Cl.[5] ..... B67D 5/64

[52] U.S. Cl. ..... 222/173; 222/153; 248/551

[58] Field of Search ..... 222/173, 153, 180, 184, 222/, 321, 383, 384, 385, 463; 248/551

[56] References Cited

U.S. PATENT DOCUMENTS

| | | | |
|---|---|---|---|
| 231,597 | 8/1880 | Matthews | 222/173 |
| 1,264,215 | 4/1918 | Skociokh | 222/173 X |
| 2,307,291 | 1/1943 | Packwood, Jr. | 248/551 X |
| 2,319,233 | 5/1943 | Hoppe | 248/551 X |
| 2,837,245 | 6/1958 | Grebowiec | 222/184 |
| 3,278,086 | 10/1966 | Clouzeau et al. | 222/173 X |
| 4,880,151 | 11/1989 | Shepherd | 222/394 |
| 5,062,549 | 11/1991 | Smith et al. | 222/184 X |

FOREIGN PATENT DOCUMENTS

| | | | |
|---|---|---|---|
| 2034799 | 6/1980 | United Kingdom | 248/551 |

*Primary Examiner*—Kevin P. Shaver

*Attorney, Agent, or Firm*—Brady, O'Boyle & Gates

[57] ABSTRACT

A liquid soap dispenser and a mounting base for connection to a counter top on a sink in a public washroom to prevent the unauthorized removal of the dispenser. The dispenser includes a bottle having a spherical bottom wall which prevents the bottle from being self-supporting if removed from the mounting base.

18 Claims, 2 Drawing Sheets

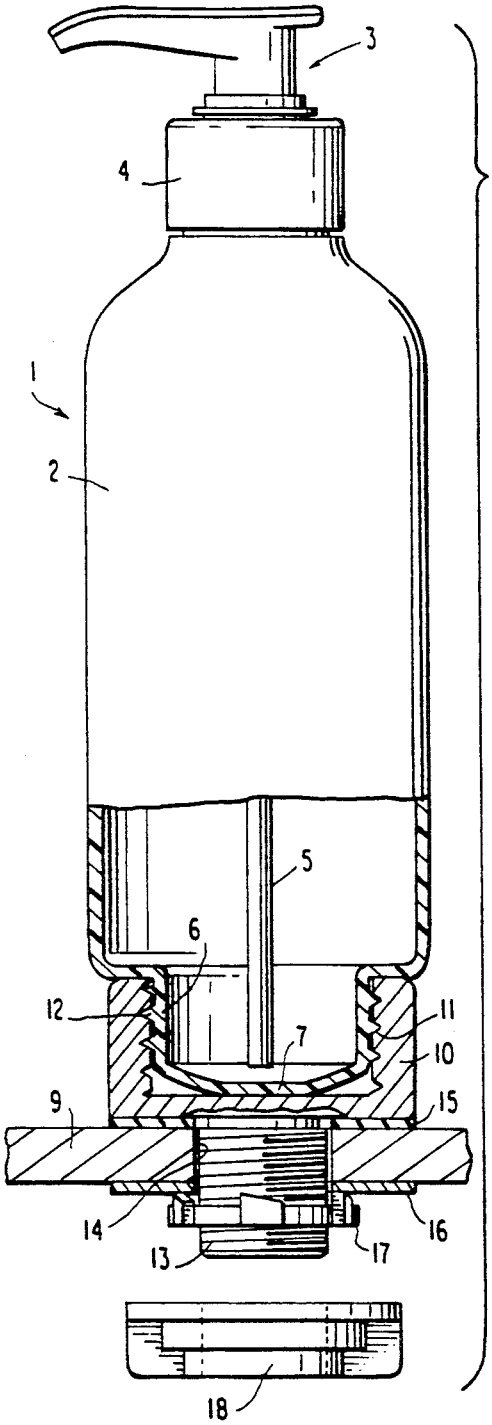
FIG. 1
FIG. 2
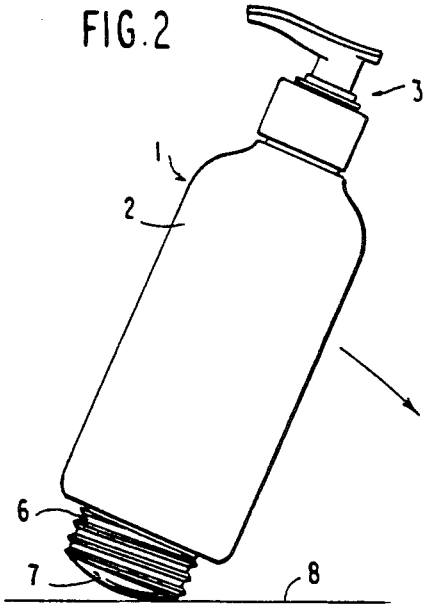
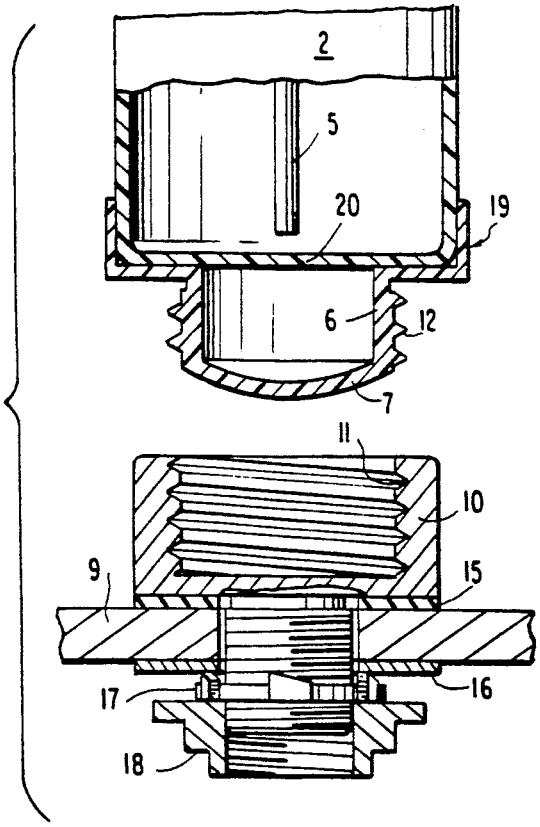
FIG. 3

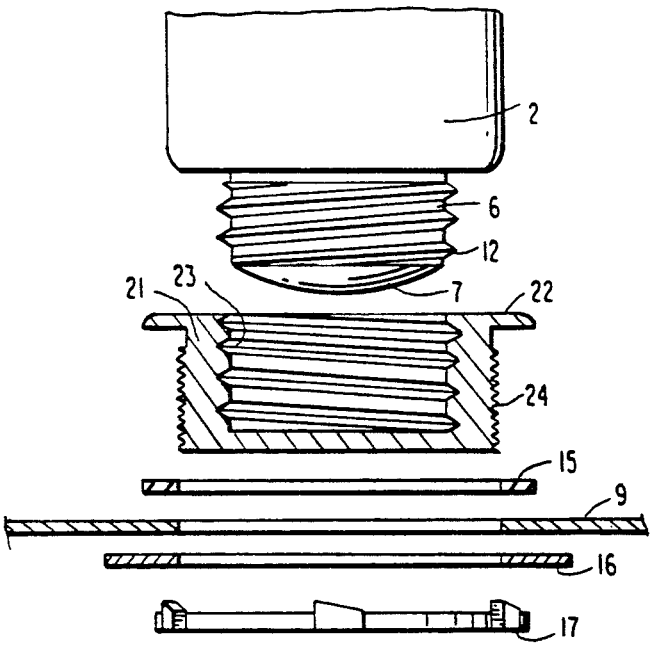
FIG. 4
FIG. 5
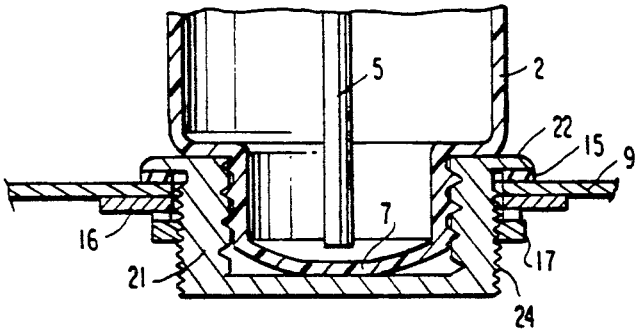
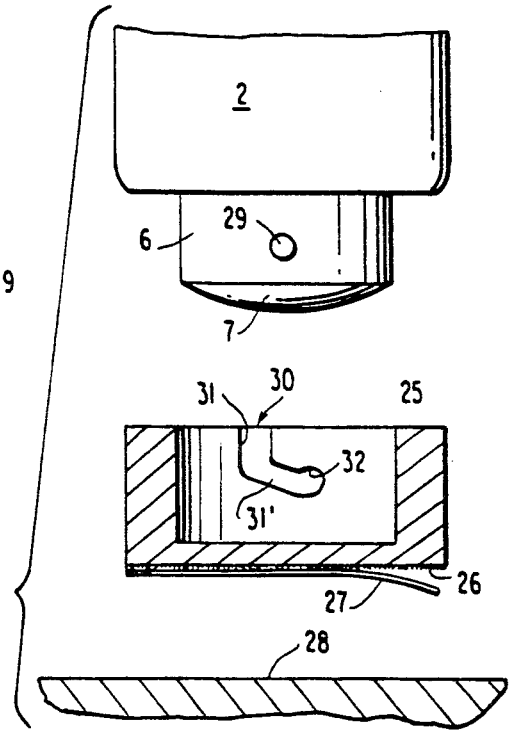
FIG. 6
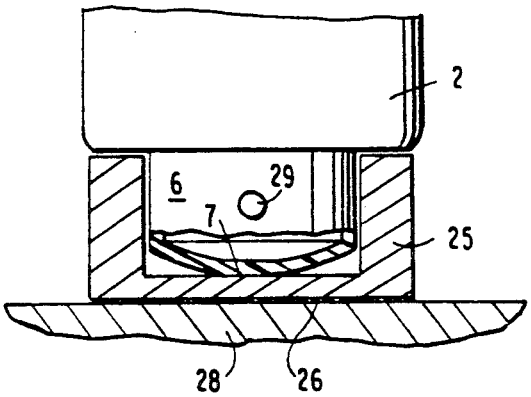
FIG. 7

LIQUID SOAP DISPENSER WITH MOUNTING BASE

BACKGROUND OF THE INVENTION

Various liquid soap dispensers have been proposed wherein a container containing the liquid soap is provided with a discharge assistant in the nature of a manually actuated reciprocating pump attached to the container for dispensing measured amounts of liquid soap therefrom.

When providing these dispensers in public lavatories, or washrooms in business establishments, such as shops and restaurants, and in common carriers, such as tour buses and airplanes, it is necessary to secure the dispenser container either to the lavatory sink counter top or lavatory wall adjacent the sink to not only prevent the unauthorized removal of the dispenser container but also to prevent the shifting or sliding of the container on the sink counter top while the common carrier is underway, for instance, during take-off and landing in the case of an airplane.

U.S. Pat. Nos. 1,229,556 dated Jun. 12, 1917, and 2,883,139, disclose liquid soap dispensers of the type noted hereinabove.

SUMMARY OF THE INVENTION

The liquid soap dispenser of the present invention has been devised for not only fixedly mounting the container on a sink counter top but also to discourage, if not prevent, the unauthorized removal of the container. The liquid soap dispenser of the present invention comprises, essentially, a container such as a plastic bottle. A protrusion having a spherical end wall is integral with the lower end of the bottle and the protrusion is detachably fastened to a base member fixedly mounted on the sink counter top, whereby the liquid soap dispenser is secured to the sink counter top, and extends in a vertical plane upwardly therefrom. By the construction and arrangement of the spherical end wall of the protrusion, if an unauthorized person should remove the bottle from the base member, the spherical-shaped protrusion on the bottom of the bottle assures that, without the base member, the bottle tips over on its side and therefore will not be able to stand upwardly on a supporting surface, thereby making it a difficult product to use.

BRIEF DESCRIPTION OF THE DRAWINGS

FIG. 1 is a side elevational view, partly in section, illustrating one embodiment of the soap dispenser bottle and mounting base of the present invention;

FIG. 2 is a side elevational view of the soap dispenser bottle of the present invention removed from the base and illustrating its inability to stand upwardly on a horizontal supporting surface;

FIG. 3 is an exploded, fragmentary, sectional, side elevational view of the dispenser bottle and mounting base similar to FIG. 1 but illustrating another embodiment of the spherical protrusion integral with the bottom of the bottle;

FIG. 4 is an exploded, fragmentary, sectional side elevational view of the lower end of the dispenser bottle and illustrating another embodiment of the mounting base member;

FIG. 5 is a fragmentary, sectional view showing the dispenser bottle and mounting base of FIG. 4 in the connected position;

FIG. 6 is an exploded, fragmentary, sectional view showing yet another embodiment of the spherical protrusion on the bottom of the bottle, and yet another embodiment of a mounting base; and FIG. 7 is a fragmentary, sectional, side elevational view showing the bottle and base of FIG. 6 in the connected position.

DESCRIPTION OF THE PREFERRED EMBODIMENTS

Referring to the drawings and more particulary to FIG. 1, the liquid dispenser 1 of the present invention comprises a plastic bottle 2, having a conventional manually actuated pump and spout assembly 3 mounted on a cap 4 threadably connected to the neck of the bottle, the pump including a dip tube 5 extending to the bottom of the bottle 2, whereby measured amounts of liquid, such as soap, hand lotion, and the like, can be dispensed from the bottle by manually pushing downwardly and releasing the pump and spout assembly 3.

The bottom of the bottle is formed with an integral, cylindrical protrusion 6 having a spherical bottom wall 7. By this construction and arrangement, the bottle 2 cannot support itself in an erect or vertical position on a supporting surface 8 as shown in FIG. 2.

In order that the dispensing bottle 2 can be supported on a horizontal surface, such as a sink counter top 9, shown in FIGS. 1 and 3, a mounting base 10 is provided having internal threads 11 which cooperate with external threads 12 formed on the protrusion 6. The base 10 is secured to the counter top 9 by an integral, threaded stud 13 depending from the bottom of the base 10 and extending through a hole 14 provided in the counter top 9. An elastomeric washer 15 is interposed the bottom of the base 10 and the upper surface of the counter top 9, and a metal washer 16 is interposed the bottom surface of the counter top 9 and a lock washer 17 threadably mounted on the lower end portion of the stud 13. To maintain the lock washer 17 and associated base 10 in a fixed, locked position on the counter top, a wing nut 18 is threaded onto the lower end of the stud 13 and fastened up against the lock washer 17.

To mount the bottle 2 on the base 10, the protrusion portion 6 is threaded into the base 10 as shown in FIG. 1 to an extent whereby the spherical end portion 7 thereof tends to become flattened out resulting in an upwardly biasing force acting on the cooperating threads 11 and 12, causing them to become substantially locked together.

While the protrusion 6 on the bottle 2 illustrated in FIG. 1 is molded integrally with the side wall to form the bottom wall of the bottle 2, the protrusion 6, shown in FIG. 3, is formed as a separate unit 19 and welded or adhesively secured to the bottom wall 20 of the bottle 2.

In certain installations where the size of the counter top hole is substantially larger than the hole 14 illustrated in FIG. 1, a base 21, as shown in FIGS. 4 and 5, is used which is essentially a cup having an upper flange portion 22, internal threads 23 which cooperate with the threaded protrusion 6, and external threads 24 which cooperate with the threaded lock washer 17. In the mounted position, as shown in FIG. 5, the flange portion 22 rests on the elastomeric washer 15, and the lock washer 17 forces the metal washer 16 upwardly against the bottom surface of the counter top 9. Once again, the flattened spherical end wall 7 provides the biasing force for substantially locking the cooperating threads 12 and 23 into engagement.

FIGS. 6 and 7 illustrate further embodiments of the mounting base and fastener for connecting the bottle to the base wherein the base 25 is in the form of a cup having a pressure-sensitive adhesive layer 26 on the bottom wall thereof, the adhesive layer 26 being protected by a sheet of paper 27 having a release coating, whereby the protective sheet 27 can be peeled off the adhesive layer 26 and the base 25 can be pressed against a support surface 28 and adhesively secured thereto.

in lieu of the threaded connections employed in the embodiments of FIGS. 1 to 5, for securing the bottle 2 to the bases 10 and 21, a bayonet-type connection can be employed as shown in the embodiment of FIGS. 6 and 7, wherein a pin 29 is provided extending radially outwardly from the cylindrical side wall of the protrusion 6. The pin 29 is adapted to be received in a slot 30 formed in the side wall of the base 25, the slot 30 having a vertical portion 31 communicating at its lower end with a downwardly extending diagonal portion 31' which terminates in arcuate recess 32. While for purposes of the description only one pin 29 and one slot 30 are illustrated, it will be understood that the protrusion 6 will be provided with a pair of diametrically oppositely extending pins 29 molded integrally on the protrusion 6, and the base 25 will be similarly provided with diametricaly opposite slots 30 having the recess portions 32 extending in opposite directions, whereby when the protrusion 6, and associated pins 29, is inserted into the base 25, the pins slide downwardly in slot portions 31. The bottle 2 is then pressed downwardly and rotated to cause the pins 29 to move downwardly in the diagonal slot portions 31', and then into the slot recess portions 32. During this downward rotating movement, the spherical end portion 7, since it is constructed of yieldable plastic material and in a form to have memory, is deformed as it contacts the inside bottom surface of base 25 to become flattened over a portion of the spherical surface, and as the pins 29 move somewhat upwardly into the arcuate recesses 32, and the bottle 2 is released, the spherical end portion 7 becomes less flat, but still remains sufficiently flattened to provide an upwardly biasing force to push the pins 29 upwardly into the recesses 32 and effectively locking them in the recesses to discourage and inhibit removal of the dispenser bottle from base 25. The downwardly extending diagonal slot portions 31' cooperating with the pins 29 during the rotating downward movement provide a camming action to facilitate the flattening of spherical end portion 7 to provide the upward biasing force.

From the above description, it will be readily appreciated by those skilled in the art that the liquid soap dispenser and cooperating mounting bases of the present invention can be readily mounted on sink counter tops as standard equipment, or retrofitted on existing sink counter tops, and by their construction and arrangement the bottle cannot be easily removed from the base, and if it is removed, the spherical protrusion will prevent the bottle from standing upwardly on a supporting surface, thereby making the bottle and associated dispenser a difficult product to use without the base, and thus discouraging and inhibiting theft of the filled dispenser bottles The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A liquid dispenser and a mounting base comprising, a bottle having a bottom wall, a discharge assistant connected to said bottle, a protrusion connected to the bottom wall of said bottle, a spherical end wall formed on said protrusion, whereby the bottle is prevented from standing upwardly on a horizontal supporting surface; a mounting base, means for securing said mounting base to a horizontal supporting surface, and means for fastening said protrusion to said mounting base, whereby the bottle is supported on said horizontal surface in an upwardly standing position.

2. A liquid dispenser and a mounting base according to claim 1, wherein the means for fastening the protrusion to the mounting base comprises a threaded connection between the protrusion and the base member.

3. A liquid dispenser and a mounting base according to claim 1, wherein the means for fastening the protrusion to the mounting base comprises a bayonet-type connection between the protrusion and the base member.

4. A liquid dispenser and a mounting base according to claim 1, wherein the protrusion is formed integrally with the side wall of the bottle to thereby form the bottom wall of the bottle.

5. A liquid dispenser and a mounting base according to claim 1, wherein the protrusion comprises a separate unit secured to the bottom wall of the bottle.

6. A liquid dispenser and a mounting base according to claim 2, wherein the mounting base comprises a cup member and said threaded connection comprises internal threads on said cup member cooperating with external threads on the protrusion.

7. A liquid dispenser and a mounting base according to claim 6, wherein the means for securing the mounting base to the supporting surface comprises a threaded stud depending from the cup member and extending through a hole in the supporting surface, and a lock washer threadably mounted on said stud.

8. A liquid dispenser and a mounting base according to claim 7, wherein an elastomeric washer is interposed the base member and the top of the supporting surface, and a metal washer is interposed the bottom of the supporting surface and the lock washer.

9. A liquid dispenser and a mounting base according to claim 8, wherein a wing nut is threadably mounted on the end portion of the stud and abuts the lock washer.

10. A liquid dispenser and a mounting base according to claim 6, wherein the means for securing the mounting base to the supporting surface comprises, external threads provided on the side wall of the cup member extending through a hole in the supporting surface, and a lock washer threadaby mounted on said external threads.

11. A liquid dispenser and a mounting base according to claim 10, wherein an upper flange portion is provided on said cup, an elastomeric washer interposed the flange portion and the top of the supporting surface, and a metal washer interposed the bottom of the supporting surface and the lock washer.

12. A liquid dispenser and a mounting base according to claim 3, wherein the mounting base comprises a cup member and said bayonet-type connection comprises slots formed in the side wall of said cup member receiving a pair of radially outwardly extending pins mounted on the protrusion.

13. A liquid dispenser and a mounting base according to claim 12, wherein said means for securing said mounting base to the supporting surface comprises a layer of pressure-sensitive adhesive on the bottom of the cup member.

14. A liquid dispenser and a mounting base according to claim 1, wherein said means for securing said mounting base to the supporting surface comprises a layer of pressure-sensitive adhesive on the bottom of said mounting base.

15. A liquid dispenser and a mounting base according to claim 1, wherein said means for securing said mounting base to the supporting surface comprises a threaded stud depending from said mounting base for extending through a hole in the supporting surface, and lock washer means threadably mounted on said stud.

16. A liquid dispenser and a mounting base according to claim 1, wherein said means for securing said mounting base to the supporting surface includes said mounting base having a side wall, external threads provided on said side wall of said mounting base for extending through a hole in the supporting surface, and lock washer means threadably mounted on said external threads.

17. A liquid dispenser and a mounting base according to claim 16, and said mounting base having an upper flange portion thereon extending radially beyond said external threads for overlying the supporting surface.

18. The combination of a bottle and a mounting base comprising, a bottle having a bottom wall, a protrusion connected to the bottom wall of said bottle, a spherical end wall formed on said protrusion, whereby the bottle is prevented from being self supporting on a horizontal surface; said mounting base comprising, a cup member receiving the protrusion on the bottom of the bottle, said cup member having a bottom wall, means for securing said mounting base to a horizontal surface, and means for fastening said protrusion in said cup member, the spherical end wall of the protrusion engaging the bottom wall of the cup member and being deformed thereon to provide an upwardly biasing force against the fastening means to enhance the securing effect of the fastening means.

* * * * *